US006947008B2

(12) United States Patent
Tillery et al.

(10) Patent No.: US 6,947,008 B2
(45) Date of Patent: Sep. 20, 2005

(54) CONFORMABLE LAYERED ANTENNA ARRAY

(75) Inventors: James Tillery, Woodstock, GA (US); Donald L. Runyon, Duluth, GA (US)

(73) Assignee: EMS Technologies, Inc., Norcross, GA (US)

( * ) Notice: Subject to any disclaimer, the term of this patent is extended or adjusted under 35 U.S.C. 154(b) by 0 days.

(21) Appl. No.: 10/355,114

(22) Filed: Jan. 31, 2003

(65) Prior Publication Data

US 2004/0150561 A1 Aug. 5, 2004

(51) Int. Cl.[7] ..... H01Q 21/08
(52) U.S. Cl. ..... 343/824; 343/853; 343/893
(58) Field of Search ..... 343/700 MS, 846, 343/853, 824, 829, 893

(56) References Cited

U.S. PATENT DOCUMENTS

| | | | | | |
|---|---|---|---|---|---|
| 4,766,444 | A | | 8/1988 | Conroy et al. | 343/895 |
| 4,829,309 | A | * | 5/1989 | Tsukamoto et al. | 343/700 MS |
| 5,061,943 | A | * | 10/1991 | Rammos | 343/770 |
| 5,510,803 | A | | 4/1996 | Ishizaka et al. | 343/700 MS |
| 5,596,336 | A | * | 1/1997 | Liu | 343/770 |
| 5,614,915 | A | * | 3/1997 | Webb | 343/770 |
| 5,829,121 | A | | 11/1998 | Shoemaker et al. | 29/600 |
| 5,872,545 | A | * | 2/1999 | Rammos | 343/770 |
| 5,874,919 | A | * | 2/1999 | Rawnick et al. | 343/700 MS |
| 6,031,491 | A | | 2/2000 | Daniel et al. | 343/700 MS |
| 6,114,997 | A | * | 9/2000 | Lee et al. | 343/700 MS |
| 6,144,344 | A | | 11/2000 | Kim | 343/770 |
| 6,356,245 | B2 | | 3/2002 | Metzen | 343/905 |
| 6,462,711 | B1 | | 10/2002 | Zaghloul | 343/700 MS |
| 6,489,924 | B2 | | 12/2002 | Pretorius | 343/700 MS |
| 6,703,114 | B1 | | 3/2004 | Guiles et al. | 428/209 |
| 6,768,471 | B2 | * | 7/2004 | Bostwick et al. | 343/853 |
| 6,822,616 | B2 | * | 11/2004 | Durham et al. | 343/795 |
| 2002/0004125 | A1 | | 1/2002 | Ostrovsky | 428/220 |
| 2002/0109633 | A1 | | 8/2002 | Ow | 343/700 MS |
| 2004/0104852 | A1 | | 6/2004 | Choi | 343/700 MS |

FOREIGN PATENT DOCUMENTS

| | | |
|---|---|---|
| EP | 0 468 413 A2 | 7/1991 |
| EP | 0 651 458 A1 | 5/1995 |
| WO | 02/50953 A1 | 6/2002 |

OTHER PUBLICATIONS

International Search Report dated Jul. 3, 2003, for Application No. PCT/US03/02752.

* cited by examiner

*Primary Examiner*—Thuy Vinh Tran
(74) *Attorney, Agent, or Firm*—Hogan & Hartson LLP

(57) ABSTRACT

A low-cost antenna array and method of manufacturing the array, in a planar form or in a structurally flexible or curved array structure are shown. The antenna array has a plurality of metallic antenna electrical and radiator elements formed on a foam core layer bonded onto a metallic ground layer. The radiator elements preferably are formed on a thin dielectric carrier layer bonded to the foam core layer. The array can include one or more additional dielectric layers, each with a plurality of parasitic radiator elements formed thereon, mounted on top of the electrical elements. Manufacturing the array preferably includes bonding the layers to one another. The electrical and radiator elements are formed, preferably by etching, before the foam core layer is bonded to the ground layer. The additional dielectric layer and the parasitic radiators then are bonded to the already formed electrical elements on the ground layer.

53 Claims, 15 Drawing Sheets

CONFORMABLE LAYERED ANTENNA ARRAY

BACKGROUND OF THE INVENTION

1. Field of the Invention

The present invention relates to antenna arrays and, more particularly, is directed to low-cost antenna arrays and methods of manufacturing antenna arrays having substantially planar and curved surfaces for telecommunications applications.

2. Description of the Related Art

Antenna arrays have been manufactured in a variety of forms and have many different applications in the communications field. One particular application with a high volume and an emphasis on cost of the antenna arrays is for use in base-stations of mobile communication systems, such as cellular transmissions operating at about 800 MHz and Personal Communication Services (PCS) transmissions operating at about 1900 MHz in the United States, as well as other wireless and mobile communication applications worldwide.

Base-station antenna arrays have been formed using a wide variety of structures having significant variations in size, cost and reliability. Conventional base-station antenna arrays typically include two or more individual radiators, a transmission network to distribute RF power among the radiators from an interface port of the antenna, a mechanical structure securing all the elements into an assembly, and a protective radome. One basic type of base-station antenna array is formed from a known array of cylindrical dipoles. These antenna arrays generally have a large number of components, a high cost for manufacturing the structures, large physical size and a relatively heavy weight. Another basic type of base-station antenna array is formed using sheet metal dipole radiators and a micro-strip power distribution network formed from sheet metal supported by discrete dielectric spacers. The individual metal parts are typically stamped from aluminum sheet stock and then assembled in a labor-intensive operation. Another conventional base-station antenna array uses printed circuit boards (PCB's) for power dividing circuits and metal dipole or patch radiators interconnected using coaxial cables.

Another type of conventional base-station antenna array uses PCB's for the power distribution network and separate PCB's for the dipole radiators. For base station antennas with high gain values and having greater than eight radiators it is generally necessary to use high performance polytetrafluoroethylene (PTFE) based PCB materials for the power distribution network for maintaining low network losses due to signal dissipation. High performance PTFE based PCB materials have a significantly higher cost compared to other types of PCB materials. Base-station antennas constructed using PCB's for the power distribution network and for the radiators can offer advantages over similar antennas constructed using sheet metal with regard to manufacturing tooling costs, reproduction, ease of assembly, and can facilitate greater circuit complexity.

Planar antenna arrays of various constructions have been proposed to decrease the cost of manufacturing, the physical size and weight of the resulting antenna arrays. These arrays have been formed in various structures utilizing a variety of sandwich type arrangements and with various types of materials for the antenna radiators and circuitry. Planar antenna arrays have conventionally been formed by screen-printing, by physically cutting a metal layer, such as by punching out radiator patches or by cutting the metal to form the radiator patches in the metal layer, and by etching of the metal layer to form the desired pattern. These types of antennas have included one or more circuits and radiators formed of very thin metallic layers or foils which then are supported or mounted on various types of generally rigid dielectric substrates, such as plastic, foam, Styrofoam™, PVC resin, fiberglass, polypropylene, polyester, acrylic or polyethylene. While these conventional array structures have improved some characteristics of antenna arrays, such as the number of components and weight, the electrical performance, the cost of the manufacturing process and the resulting mechanical structures need to be improved.

Accordingly, there is a need for an antenna array, that may be used, for example, in base-station applications, which can be manufactured at a reduced cost. It also would be desirable to attain the desired reduced cost of the arrays while maintaining acceptable electrical performance of the antenna array. It would further be desirable to form a flexible antenna array, which can have a curved structure for certain applications.

SUMMARY OF THE INVENTION

The present invention is directed to low-cost antenna arrays and methods for manufacturing such arrays for communications applications, such as for utilization as base-station antennas. The antenna arrays in accordance with the invention may also be designed in a planar form or in a structurally flexible or curved array structure, which is desirable for some applications.

The antenna array in accordance with an embodiment of the invention is formed of a plurality of layers, the layers preferably bonded to one another. The array may include a plurality of metallic radiator elements formed on two or more dielectric layers, which are in turn bonded onto a metallic ground layer. The thicknesses of the dielectric layers are chosen to provide the desired spacing for the operation of the radiator elements. The radiator elements may be preferably formed on a flexible dielectric carrier layer and the carrier layer may be bonded to a dielectric foam core layer that can be flexible or can be molded or cut to planar or non-planar shapes. The array may include one or more dielectric layers with a plurality of parasitic radiator elements formed thereon, where the dielectric layers preferably are bonded on top of the metallic radiator elements. The layers and ground can be enclosed in a structure that includes a radome and provides for environmental protection and facilitates mounting the antenna assembly in a secure and robust manner to other structures.

The method of manufacturing the array in accordance with embodiments of the invention may include bonding the layers to one another. The radiator elements may preferably be formed by etching a metal layer before the foam core dielectric layer is bonded to the ground layer. The dielectric layers with the parasitic elements then can be bonded to the already formed radiator elements. The ground layer can be partially or totally curved as desired.

The low-cost antenna array design in accordance with embodiments of the invention uses low-cost individual components suitable for printed circuit board manufacturing techniques that can be assembled in a short period of time with little or no required adjustment to achieve the desired performance after assembly.

The invention thus provides an antenna array having a plurality of layers which includes a metallic layer having a plurality of antenna electrical radiator elements and feed elements formed therein, a first thin carrier dielectric layer, the metallic layer formed over said first thin carrier dielectric layer, a foam core layer having a top surface and a bottom surface, wherein the first thin carrier dielectric layer is formed over the top surface of the foam core layer and a bonding layer is formed on the bottom surface of the foam core layer, wherein the bonding layer is bonded to a metallic ground layer.

Other features and advantages of the present invention will be readily appreciated upon review of the following detailed description when taken in conjunction with the accompanying drawing figures.

DETAILED DESCRIPTION OF THE PRESENT INVENTION

Figure 1:
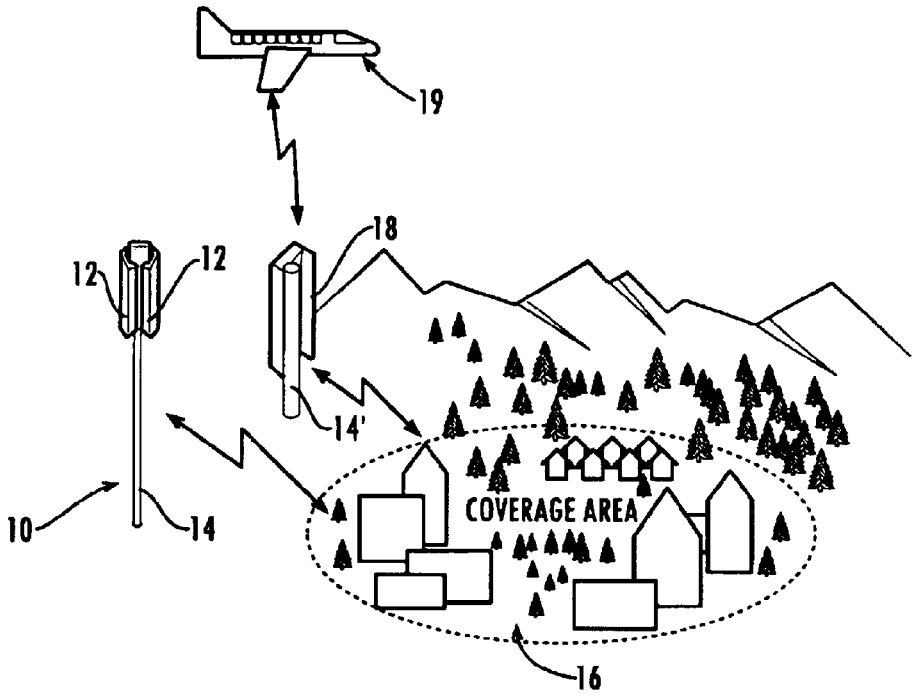
FIG. 1 illustrates utilization of antenna arrays in accordance with an embodiment of the invention in a base-station environment.
Figure 14A:
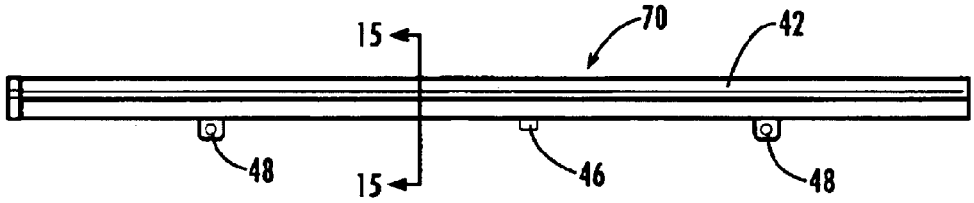
FIGS. 14A, 14B and 14C respectively are side, bottom and top views of a completed antenna array structure mounted in a radome.
Figure 14B:
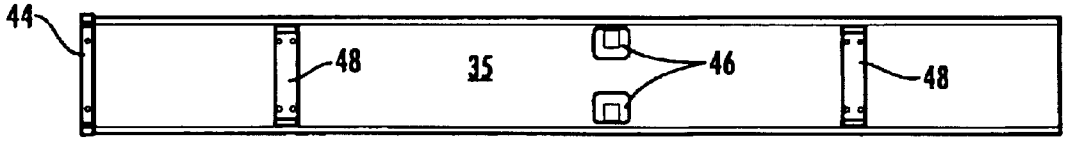
Figure 14C:
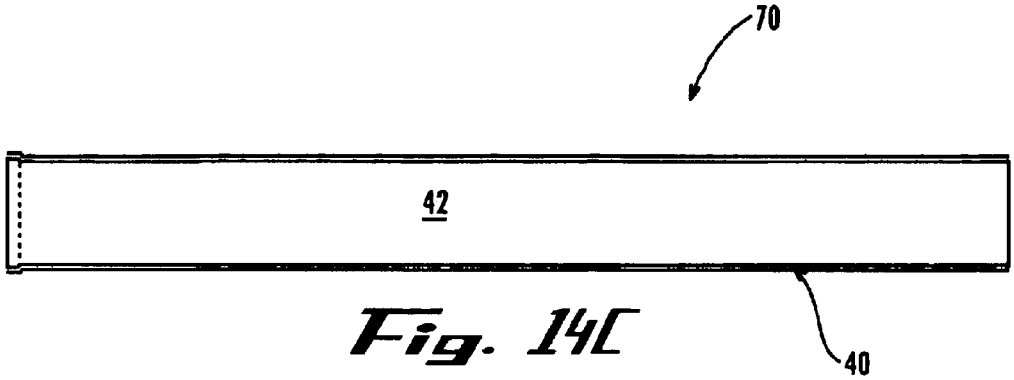
Figure 15:
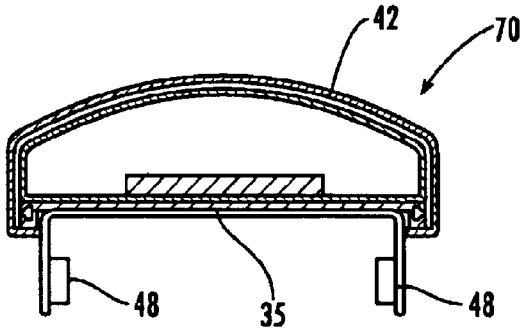
FIG. 15 is a cross-sectional view of the completed antenna array and radome structure taken along the line 15—15 of FIG. 14A.
Figure 16:
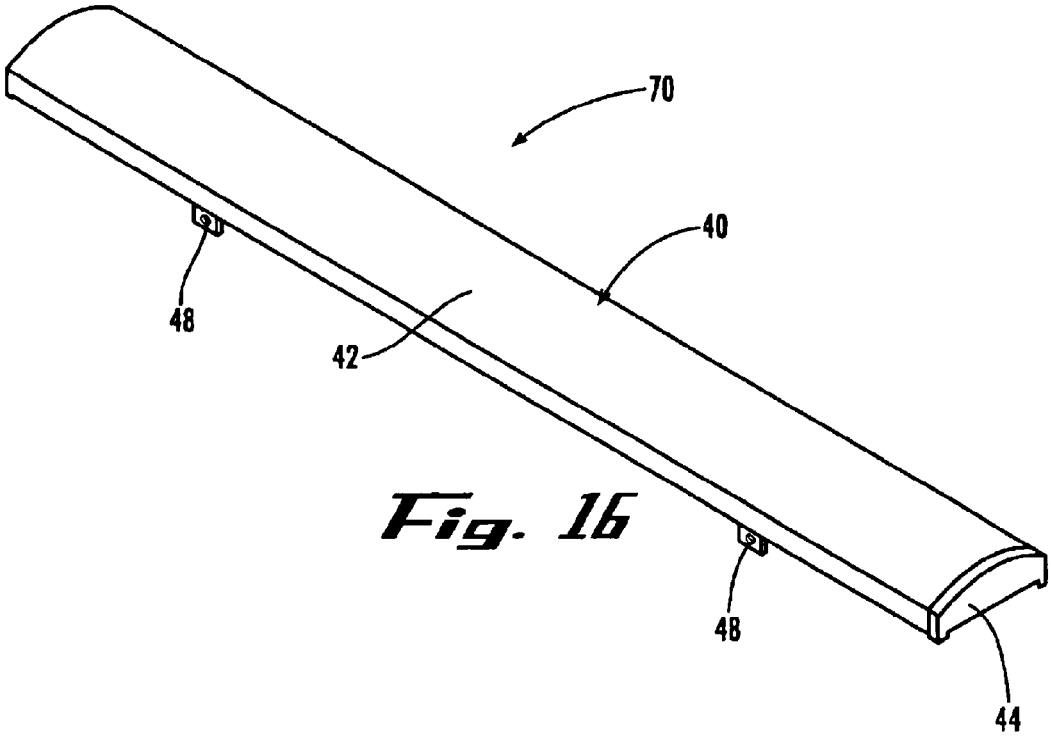
FIG. 16 is a perspective view of the completed antenna array structure of FIG. 15.

Referring now to FIG. 1, a base-station or cell site 10 can include at least one and generally a plurality of antenna arrays 12 of the present invention, examples of which are disclosed in detail in FIGS. 2–16. The same reference numerals are utilized in the figures to refer to the same or similar components in the drawings. The base-station antenna arrays 12 generally are enclosed in a substantially sealed radome (illustrated in FIGS. 14–16), which then are mounted in a conventional manner on a base-station tower 14. As utilized herein, an antenna array is an assembly of antenna elements with dimensions, spacing, and illumination sequence such that the fields for the individual radiator elements combine to produce a maximum intensity in a particular direction and minimum field intensities in other directions. The term antenna array can be used interchangeably with array antenna in describing such an assembly.

Each of the base-station antenna arrays 12 provides coverage to a cell of a mobile or fixed communication system (not illustrated), such as for cellular transmissions operating at about 800 MHz and Personal Communication Services (PCS) transmissions operating at about 1900 MHz in the United States or other wireless communication applications with fixed or mobile users of the system, such as within one or more coverage areas 16. The base-station antenna arrays of the present invention are illustrated as a planar structure as with the antenna arrays 12 and as a curved structure as with the curved antenna arrays 18 (examples of the curved structure are disclosed in detail in FIGS. 17–20). The curved antenna arrays 18 can be mounted on a second base-station tower 14' and can increase the communication coverage of the base-station 10 to locations above the coverage area 16, such as in the mountains or with an aircraft 19.

Figure 2:
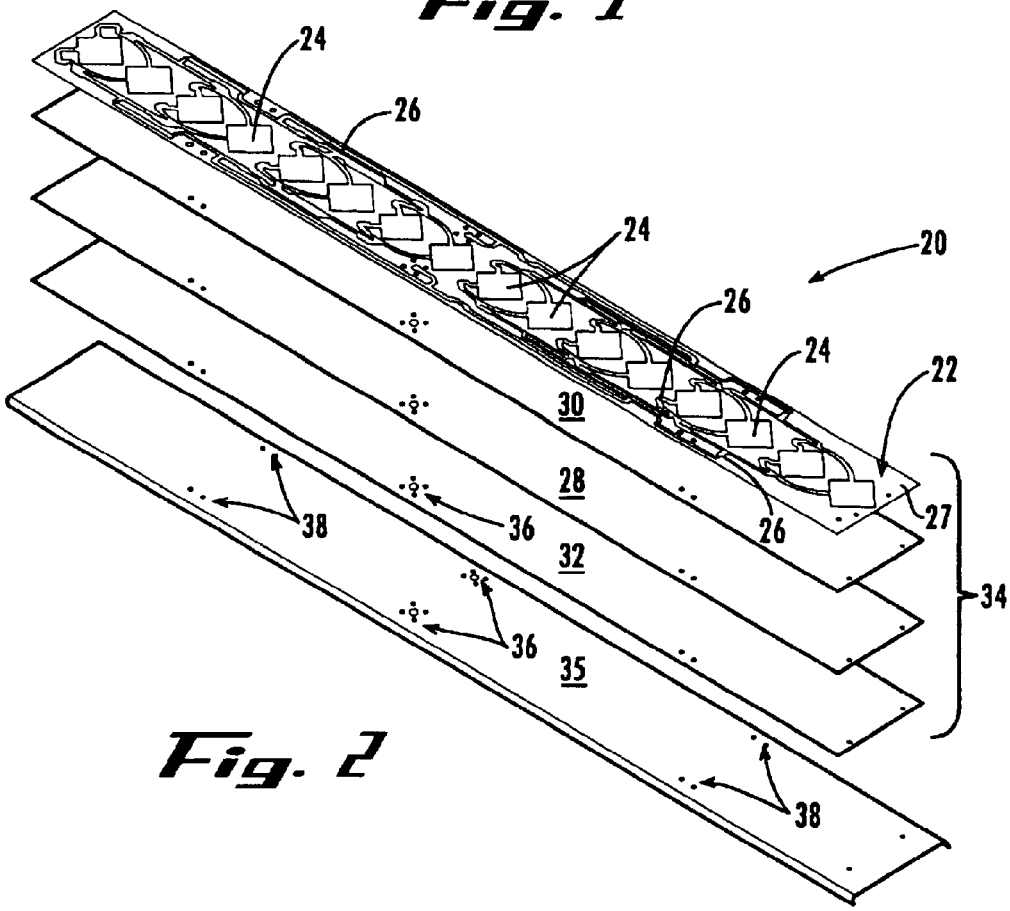
FIG. 2 is an exploded perspective illustration of antenna arrays in accordance with an embodiment of the present invention.

A first antenna array embodiment 20 of the present invention is illustrated in an exploded view in FIG. 2, with the various elements not drawn to scale in the figures. The antenna array embodiment 20 is a dual-polarized antenna having two orthogonal linear polarizations and is illustrated with sixteen individual radiators. A person skilled in the art will recognize that the invention is not limited to dual-polarized antennas and can be applied to antennas having a single characteristic polarization and can be applied to arrays with fewer or greater numbers of individual radiators than the embodiment shown. The array 20 includes a PCB stack or sandwich 22, which includes a plurality of radiator elements or patches 24 formed from a metallic layer 60 (illustrated in FIG. 5) along the length of the stack 22 with required feed circuitry 26 interconnecting the radiator elements 24 in a conventional manner. Preferably, the metallic layer 60 first is mounted or bonded onto a relatively thin carrier dielectric layer 27, such as by an adhesive layer 62 (illustrated in FIG. 5), and then the plurality of radiator elements or patches 24 can be formed, such as by a conventional chemical etching process, along the length of the stack 22 with the required feed circuitry 26 interconnecting the elements 24. It should be understood that the term bonded may include conventional techniques for bonding, including but not limited to, bonding using adhesives or fasteners.

The PCB stack 22 then is bonded to a relatively thick foam core dielectric layer 28 by an adhesive layer 30. The rest of the antenna array 20 preferably includes an adhesive and release layer 32, which is first bonded to the bottom side of the foam core dielectric layer 28, which can complete a stack or sandwich assembly 34, when the layers are bonded together. The plurality of radiator elements or patches 24 with the required feed circuitry 26 also can be formed at this point in the assembly, such as by a conventional chemical etching process. Once the radiators 24 and the required feed circuitry 26 are formed, the stack 34 is trimmed in a conventional manner. The release portion (such as a polyester or similar peel off layer, not illustrated) of the layer 32 then is removed and the stack 34 then is bonded to a ground layer or conducting tray 35 with the remaining adhesive.

Figure 3:
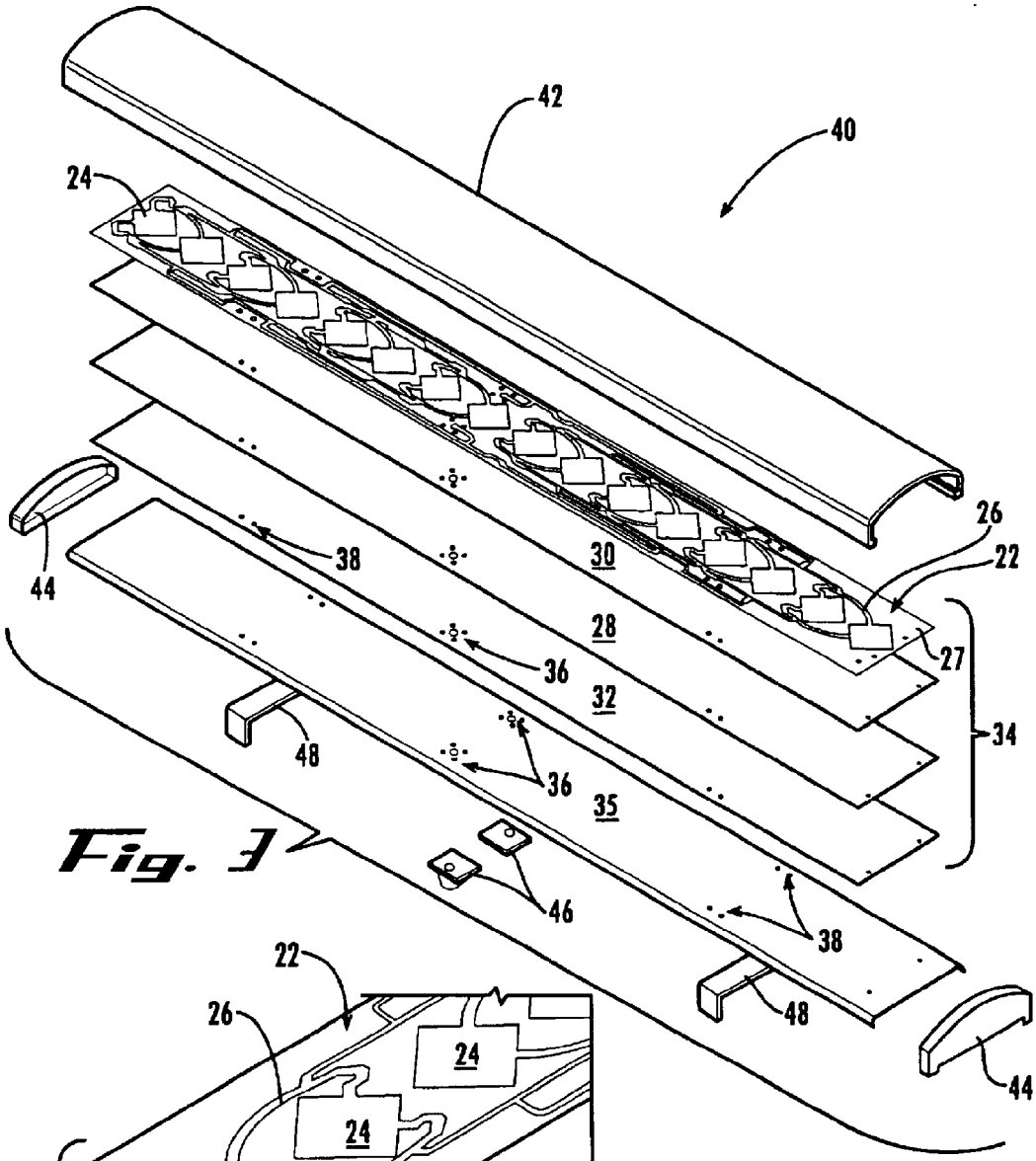
FIG. 3 is an exploded perspective illustration of the antenna array of FIG. 2 with radome elements to form a completed antenna structure.

The stack 22, the layer 28 and the conducting tray 35 each include a pair of sets of central apertures 36 which mate with one another and which are utilized for the RF connections to the feed circuitry 26 on the PCB stack 22. Another plurality of sets of mating apertures 38 are formed along the edges of the stack 22, the layer 28 and the conducting tray 35, which apertures 38 are utilized for physically mounting the mounting brackets 48 to the conducting tray 35 (as illustrated in FIG. 3). The apertures 38 in the conducting tray 35 receive the bolts or rivets or similar devices (not illustrated), while the apertures 38 in the stack 22 and the layer 28 provide clearance for the heads of the bolts.

The stack 34 and the conducting tray 35 are mounted in and form part of an antenna structure 40, with the components illustrated in FIG. 3. The antenna structure 40 forms an enclosure for the array 20 to protect the antenna from environmental conditions, such as rain, sleet, snow, dirt, wind, etc. Although the array 20 generally will be mounted in an exposed position at a base-station, the array 20 could be mounted with or without other types of protection or enclosures in other applications. The antenna structure 40 includes a radome cover member 42, which can be mounted to the bottom conducting tray 35. The ends of the radome cover 42 are enclosed by a pair of endcaps 44, which are secured by fasteners, such as rivets (not illustrated), to the ground layer 35 or to the radome cover 42 to complete the enclosed antenna structure 40.

The radome cover 42 can be manufactured from a suitable outdoor grade plastic material that can be extruded, have reasonable radio frequency properties for loss and a suitable dielectric constant. The material also should be reasonably dimensionally stable, and should not become brittle at cold temperatures. The radome material preferably is an outdoor grade Polyvinyl Chloride (PVC) which has ultra violet (UV) light stabilizer material included to provide a long life in an outdoor environment. PVC materials are a good choice and have been proven for use as base-station antenna radomes.

The ground layer 35 includes a pair of sets of central apertures 36, which mate with the apertures 36 in the other layers. The apertures 36 are utilized for a pair of RF connectors 46 to connect the RF power to the feed circuitry 26 on the PCB stack 22. The RF connectors 46 form the interface port or port connectors for antenna structure 40. The resulting antenna structure 20 or 40 provides good passive intermodulation (PIM) performance, since the only metal-to-metal contact in the structures 20 or 40 in the direct RF signal path is the solder joint at the RF connectors 46. The PIM is typically less than minus one hundred and fifty (−150) dBc when tested with two carrier tones at 20 Watts per tone.

The antenna structure 40 also preferably includes a pair of mounting brackets 48, which are secured by fasteners, such as bolts or rivets (not illustrated), to the ground layer 35 through the apertures 38, as previously discussed. The brackets 48 are utilized to mount the antenna 12 to any desired location, such as to the cell tower 14.

Figure 4:
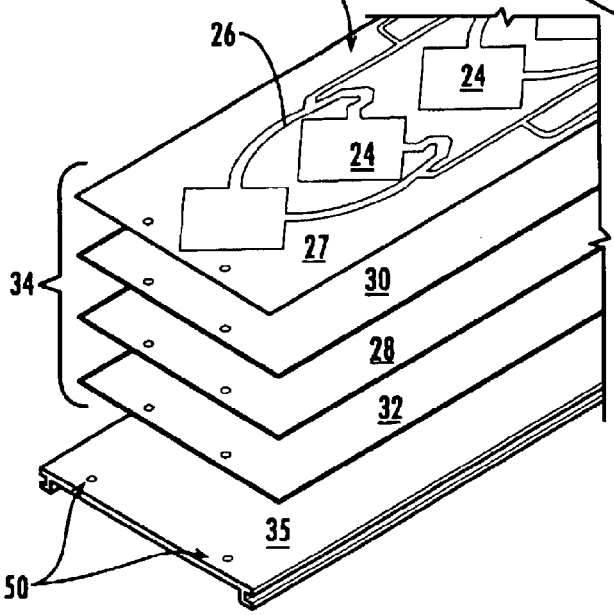
FIG. 4 is an enlarged exploded perspective partial illustration of the antenna array of FIG. 2.

The stack 34 and the ground layer 35 are illustrated in an enlarged partial perspective view in FIG. 4. The PCB stack 22 with the radiator elements 24 and the feed circuitry 26 is more clearly illustrated. Additionally, at least the layer 28 and the ground layer 35 each include a pair of apertures 50 to which the endcaps 44 are mounted. The apertures 50 also can be utilized for alignment of the stack 22, the layers 22, 28, 30 and 32 (each of which can include the apertures 50 if desired) with one another as the stack 34 is manufactured and mounted on the conducting tray 35. In general, apertures can be formed in the various layers of the stacks to provide for clearance around fasteners or protruding features that would otherwise locally protrude within the various stacks.

Figure 5:
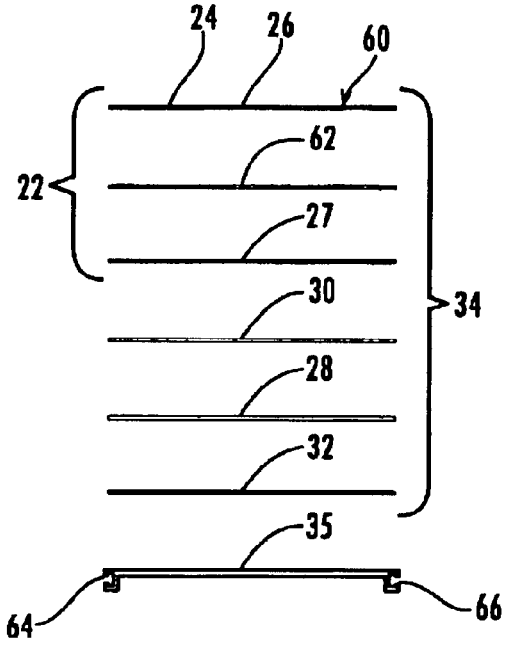
FIG. 5 is an enlarged exploded end view illustration of the antenna array of FIG. 2.

The stack 34 and the conducting tray 35 are also illustrated in an enlarged end view in FIG. 5. Again, the elements are not illustrated to scale. Additionally, the relatively thin carrier dielectric layer 27 is illustrated separately from the metallic layer 60, which has been or will be patterned to form the radiators 24 and the feed circuitry 26. The metallic layer 60 is bonded to the carrier dielectric layer 27 by an adhesive layer 62 to form the stack 22. The conducting tray 35 also preferably includes grooves 64 and 66 in opposite longitudinal edges for sliding the radome cover 42 into, before the endcaps 44 are mounted to the conducting tray 35.

Although the particular materials and layer thicknesses are not critical, some typical dimensions and materials are as follows. In one preferred embodiment, the metallic layer 60 is a thin copper foil, which is etched to form the elements 24 and 26. The foil 60 is preferably an electrodeposited (ED) type copper foil that can have chemical treatments on the surface in contact with the adhesive layer 62 on the carrier dielectric layer 27, which when treated is commonly referred to as reverse-treated copper foil. The metallic layer 60 can be one-ounce copper per square foot area that corresponds to a thickness of approximately 1.4 thousandths (0.0014) of an inch. Other copper foils can be used including the generally more expensive rolled copper foil and ED foils having reduced surface profiles on the bonded surface. Copper foils in a variety of weights such as one-half or two ounce copper per square foot can be used. A one-ounce copper foil is preferably used for cost and for its signal current capability for base-station antennas. The carrier dielectric layer 27 can be a low-loss polyester film preferably having a thickness of approximately three to five thousandths (0.003 to 0.005) of an inch thick, but up to 10 thousandths (0.010) of an inch thick. The metallic layer 60 and the relatively thin carrier dielectric layer 27 can be bonded together with a relatively thin adhesive layer 62 that can be applied with a wet coating process between the metallic layer 60 and the carrier dielectric layer 27 and when cured forms a laminate that can be handled and subsequently processed as a unitary assembly, the stack 22. The resulting laminate assembly or stack 22 is generally flexible and can be shaped with a curvature in at least one plane.

The foam core layer 28 is preferably a closed-cell foam to substantially restrict moisture uptake in the antenna environment and to allow the foam core layer 28 to be subjected to wet printed circuit board processes with relatively small amount of absorption of liquids. The foam core layer 28 can be an expanded polyolefin plastic material having a typical density of 2, 4, 6, 9, or 12 lbs per cubic foot. One such material is expanded polyethylene that is preferably cross-linked typically using radiation during manufacture to enhance the material properties. A heat activated chemical cross-linking agent can be used in other formations. One cross-linked closed cell expanded polyethylene foam using radiation is known as VultraCell™ manufactured by Vulcan Corporation, a Tennessee Corporation and a wholly owned subsidiary of Vulcan International Corporation, a Delaware Corporation. A second cross-linked closed cell expanded polyethylene foam is known as Volara™ manufactured by Voltek, a Division of Sekisui America Corporation. Voltek manufactures a variety of grades of other cross-linked, closed-cell polyolefin foam materials that can be suitable for this application. The roll type polyolefin foam materials are flexible and can take the shape of other objects to which they are bonded that can allow manufacture of antennas with curvature in one or more planes using the components described herein and conventional processing and assembly techniques.

The dielectric constant of the foam core layer 28 is dependent on the density and the dielectric constant of the expanded material, which is utilized to form the foam core layer 28. Rigid low density foams such as expanded polystyrene (EPS) in molded forms can have a typical density of 1.25 to 2.5 lbs per cubic foot. The dielectric constant for these low density foams is 1.02 to 1.04 and is nearly the dielectric constant of air. Extruded polystyrene foam can be preferred over expanded polystyrene foam due to the reduced moisture uptake resulting from reducing the small interstitial channels that occur in the expanded type foam using foam beads in the construction. Nevertheless, EPS can have sufficiently low moisture uptake for some applications. The dielectric constant of extruded cross-linked polyethylene foam with 6 lbs per cubic foot density is typically 2.3. Other cross-linked expanded polyolefin foams can have a dielectric constant value of 1.35. One foam core layer 28 which can be utilized in the invention is approximately ninety thousandths (0.090) of an inch thick. The lower values of dielectric constants generally have lower dissipation factors due to the lower density of the plastic material.

A rigid foam material that can be used for the foam core dielectric layer 28 is Rohacell™, manufactured by EMKAY Plastics Ltd. in Norwich UK. Rohacell™ is a polymethacrylimide (PMI) rigid foam free from CFCs, bromine and halogen and is stated to be 100% closed cell and isotropic. The Rohacell™ foam has excellent mechanical properties, high dimensional stability under heat, solvent resistance, and particularly a low coefficient of heat conductivity. The strength values and the moduli of elasticity and shear are presently not exceeded by any other foamed plastic of the same gross density. The Rohacell™ foam is available in a variety of densities, including 2, 3.25, 4.68, and 6.87 lbs per cubic foot. The dielectric constant of Rohacell™ foam is generally lower than the flexible polyolefin family of foams for the same density. For example, a Rohacell™ foam having 4.68 lbs per cubic foot has a dielectric constant of approximately 1.08 at 2 GHz. The Rohacell™ foam becomes thermoelastic and can therefore be shaped at a temperature of 170–190 degrees Centigrade. The required forming temperature depends on the degree of shaping and the density. Curved foam shapes can be achieved with machining or forming with heat in some cases.

The conducting tray 35 can be formed from aluminum having a thickness of approximately one-eighth (0.125) of an inch. A person skilled in the art will recognize that the conducting tray or ground layer 35 in the embodiment illustrated is also a key structural element and has the associated thickness shown for stiffness and strength. Other embodiments are possible, including relying on the radome enclosure 42 as a key structural element and then the ground layer 35 can be a relatively thin metallic layer of aluminum or other suitable conducting material, on the order of approximately three to ten thousandths (0.003 to 0.010) of an inch thick.

One embodiment of the stack 22 in FIG. 5 including the metallic layer 60, the adhesive layer 62, and the relatively thin carrier dielectric layer 27 is available from Arlon Engineered Laminates and Coatings Division in East Providence, R.I. under the product description Copper Clad Polyester Laminate (CPL). The adhesive layer 62 of the Arlon CPL product is a proprietary thermo-set urethane adhesive system of Arlon. The metallized stack 22 is available from a large number of suppliers in the flexible circuit industry when the relatively thin carrier dielectric layer 27 is a polyimide material known as Kapton™ film made by Dupont. The Arlon CPL product is preferred over polyimide film based laminates due to its lower dielectric constant and substantially lower water absorption.

The adhesive layers 30 and 62 can be acrylic pressure-sensitive transfer adhesives such as one type manufactured under the trade name VHB™ by 3M Corporation located in St. Paul, Minn. with thickness values on the order of two thousandths (0.002) to five thousandths (0.005) of an inch. Other acrylic adhesive systems also can be used including wet application systems. The present invention is not limited to the use of acrylic adhesive systems although acrylic adhesive systems are preferred. The use of a pressure sensitive adhesive (PSA) is preferred for the adhesive layer 32 to ease assembly of the stack 34 to the ground layer 35.

The relatively thin carrier dielectric layer 27 is not limited to a polyester material and can be any suitable low cost plastic material with relatively low moisture and RF energy absorption that acts essentially as an impermeable polymeric membrane between the foam core layer 28 and the copper foil 60. The plastic material also should provide a smooth surface for printing and etching and further act as a barrier to the penetration of the surface of the foam 28 by process chemicals typical to the PCB industry. The use of a relatively thin carrier dielectric layer 27 is a key element in the construction of the low cost antenna as it facilitates the use of standard PCB processes in the fabrication of the conducting patterns of the required feed circuitry 26 interconnecting the radiator elements 24 and can be easily bonded to the foam core materials 28 using conventional acrylic adhesive systems. The foam core layer 28 can be flexible or can be molded or cut to desired planar or non-planar configurations.

Figure 6:
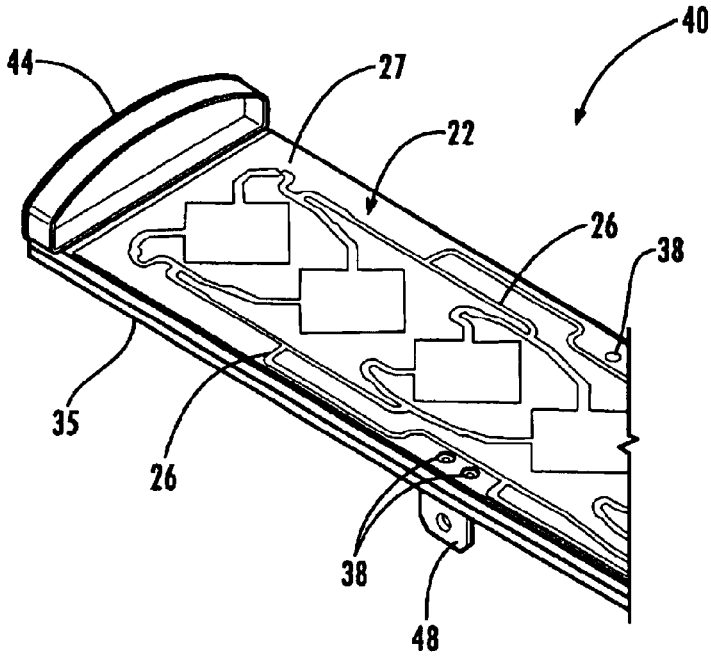
FIG. 6 is a perspective illustration of the antenna array of FIG. 2 with the radome elements forming a partially completed antenna structure.
Figure 7:
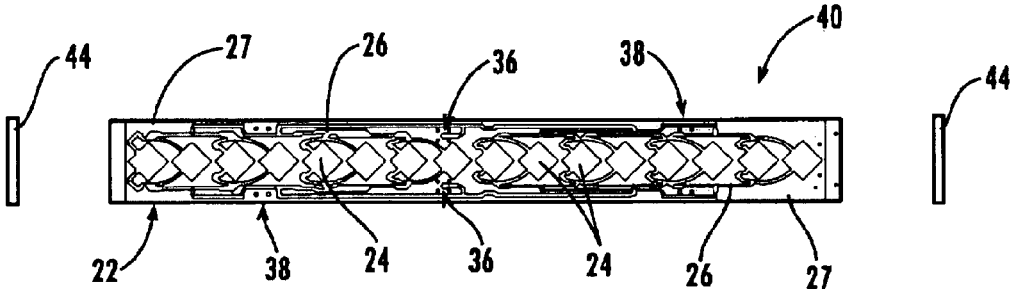
FIG. 7 is a top plan view of the partially completed antenna structure of FIG. 6.

FIGS. 6 and 7 illustrate two views of the antenna structure 40, partially assembled, with the assembled stacks 22 and 34 and the layers 28, 30 and 32 (all shown separately in FIG. 5) bonded to one another and mounted on the ground layer 35, but without the radome cover 42.

Figure 8:
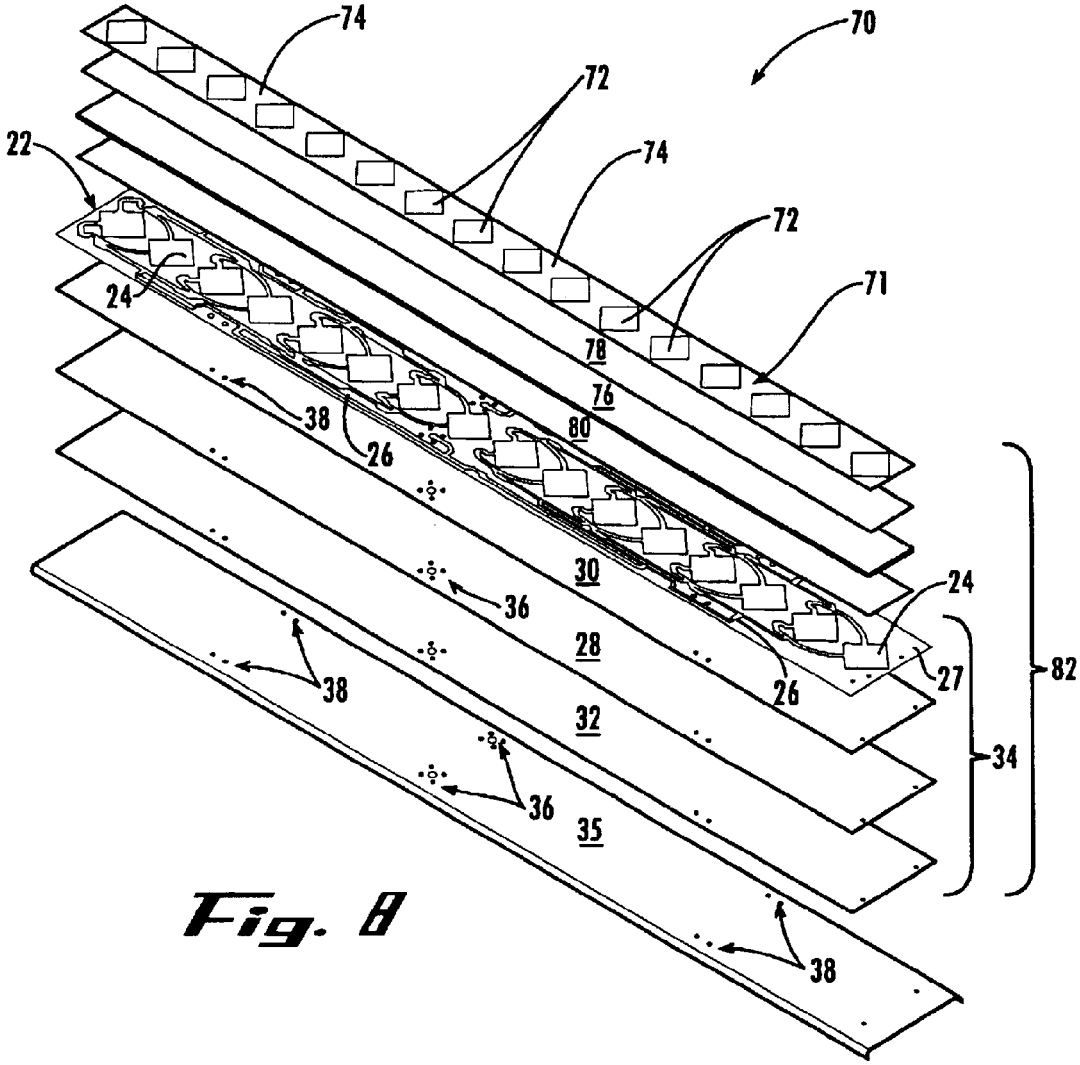
FIG. 8 is an exploded perspective illustration of an antenna array in accordance with another embodiment of the present invention.

A second antenna array embodiment 70 of the present invention, which includes a substantially identical stack 34 of the first antenna array embodiment 20, is illustrated in an exploded view in FIG. 8. In addition to the layers of the stack 34, previously described, the antenna 70 includes a stack 71, similar to the stack 22, with a parasitic set of radiator elements or patches 72 preferably formed onto or adhered to a thin carrier dielectric layer 74 by an adhesive layer (illustrated in FIG. 11). A parasitic set of radiator elements or patches 72 can be used with a driven set of radiator elements or patches 24 to increase the operational bandwidth of the antenna array 20, as compared to a similar antenna array design without a parasitic set of radiator elements or patches 72. The thin carrier dielectric layer 74 can be the same as the thin carrier dielectric layer 27. The radiator elements 72 couple parasitically with corresponding ones of the elements 24. The elements 72 do not include any feed circuitry and are spaced a predetermined distance from the stack 22 by a further dielectric layer 76 having a thickness equal to the predetermined distance for the desired parasitic coupling between the respective elements 24 and 72. The dielectric layer 76 is bonded or adhered to the stack 71 by an adhesive layer 78. The radiator elements 72 also could be bonded directly to the dielectric layer 76, without the layers 74 and 78. The layer 76 can be formed from a conventional expanded polystyrene material that can be molded or cut to the desired dimensions. The preferred embodiment of the layer 76 is a single-piece closed cell foam structure with a relatively low density value and having a substantially uniform thickness value. The dielectric layer 76 then is bonded to the top of the stack 22 by an adhesive layer 80. The stack 71 with the additional carrier dielectric layer 74, the elements 72 thereon, the dielectric layer 76 and the stack 34 form a further sandwich assembly or stack 82, mounted as previously described on the conducting tray 35.

Figure 9:
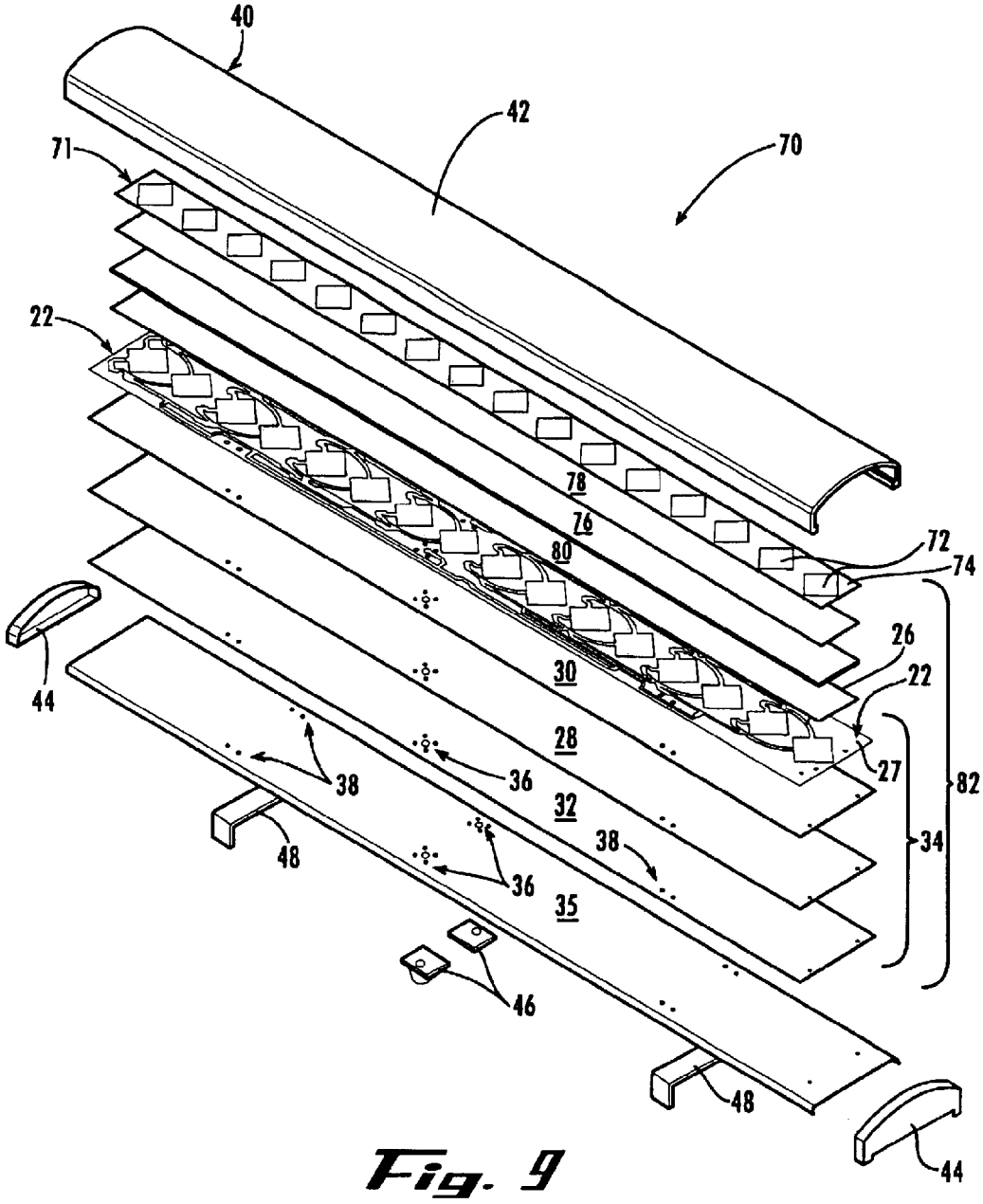
FIG. 9 is an exploded perspective illustration of the antenna array embodiment of FIG. 8 with the radome elements to form a completed antenna structure.

The stack 82 on the conducting tray 35 also is mounted in the antenna structure 40 as illustrated in FIG. 9, with the same components as those previously described with respect to FIG. 3. Other than the additional two layers 74 and 76, the two antenna structures 20 and 70 are and/or can be identical.

Figure 10:
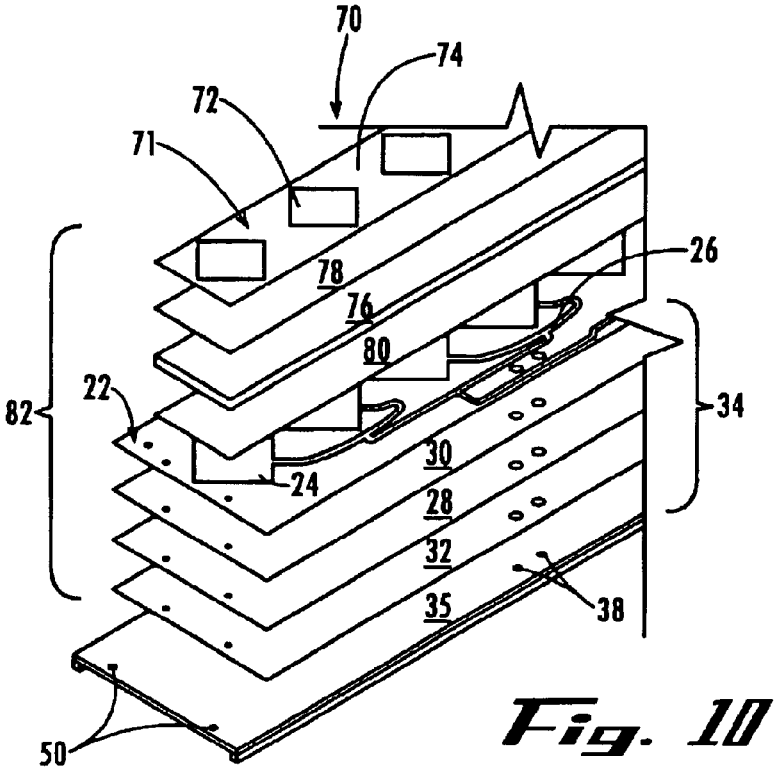
FIG. 10 is an enlarged exploded perspective partial illustration of the antenna array embodiment of FIG. 8.

The stack or sandwich 82 is illustrated in an enlarged partial perspective view in FIG. 10. The metallic stack 22 with the radiators 24 and the feed circuitry 26 is more clearly illustrated in combination with the stack 71 and the layer 76. The layer 28 and the ground layer 35 again each include the pair of apertures 50 to which the endcaps 44 are mounted. The apertures 50 again can be utilized for alignment of the layers with one another as the sandwich 82 is manufactured and mounted on the conducting tray 35.

Figure 11:
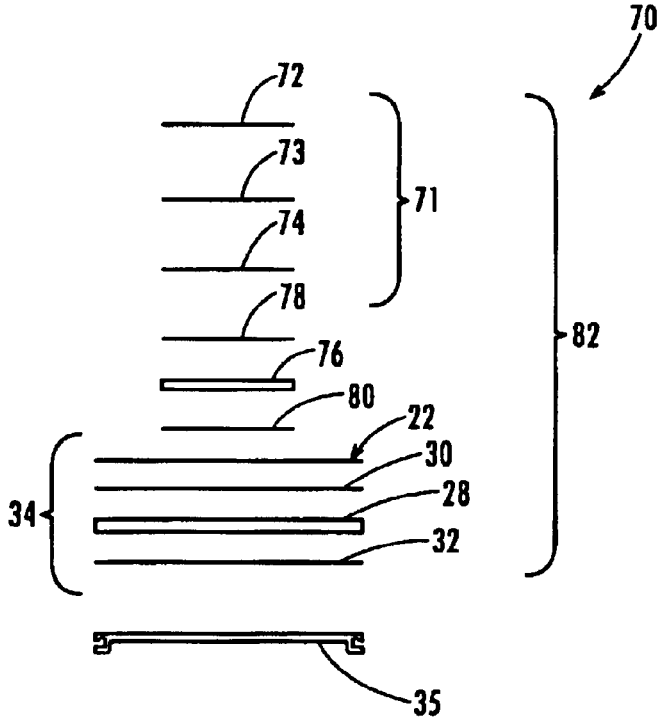
FIG. 11 is an enlarged exploded end view illustration of the antenna array embodiment of FIG. 8.

The stack 82 is also illustrated with the conducting tray 35 in an enlarged end view in FIG. 11. Again, the layers are not illustrated to scale. Additionally, the dielectric layer 74 is illustrated separately from the parasitic radiators 72 which have been or will be patterned from a metallic layer (not illustrated). The metallic layer or the formed radiators 72 are bonded to the carrier dielectric layer 74 by an adhesive layer 73. In one preferred embodiment, the metallic layer 72 can be a thin copper foil like the layer 60. The carrier dielectric layer 74 also can be a relatively thin low-loss polyester material with a thickness of about three to five thousandths (0.003 to 0.005) of an inch thick, like the layer 27. The dielectric layer 76 can be a closed-cell polystyrene with a low loss and a low dielectric constant and a thickness of about three-eighths (0.375) of an inch thick. The adhesive layers 73, 78 and 80 again are conventional pressure-sensitive adhesives having a thickness of approximately two to five thousandths (0.002 to 0.005) of an inch. In other embodiments, the metallic layer 72 can be laser-cut or die-cut sheets of aluminum, brass or copper with a thickness on the order of five hundredths (0.05) of an inch thick. The individual radiator patches 72 would then be individual pieces, which then are bonded to the carrier layer 74 or which can be bonded directly to the dielectric layer 76. When formed as individual patches, the patches 72 can be formed with any suitable thickness dimension as desired for the particular antenna application.

Figure 12:
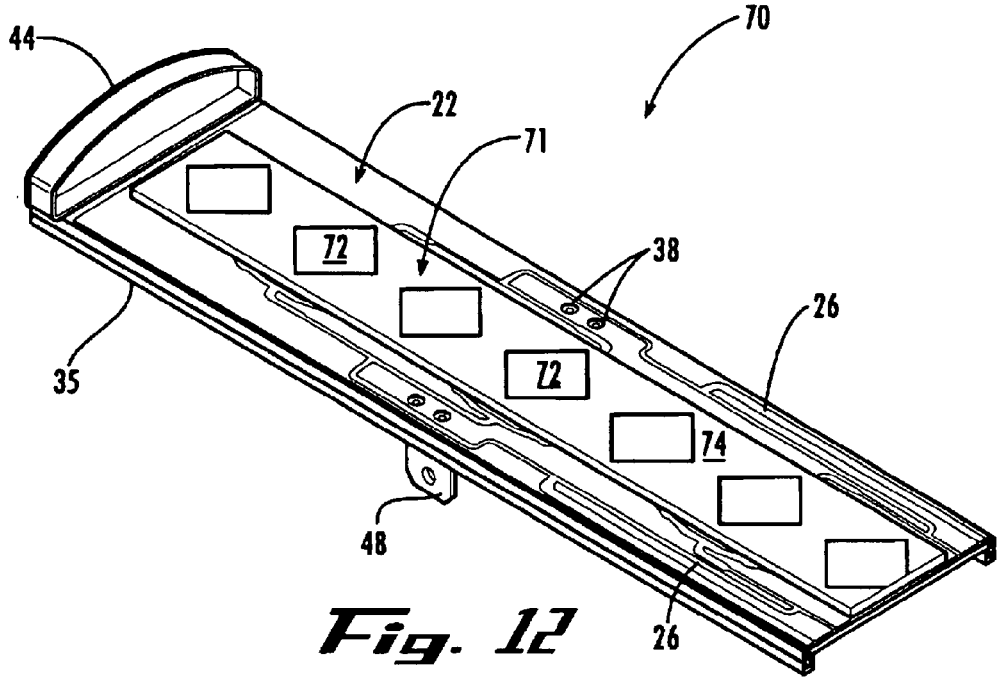
FIG. 12 is a partial perspective illustration of the antenna array embodiment of FIG. 8 with the radome elements forming a partially completed antenna structure.
Figure 13:
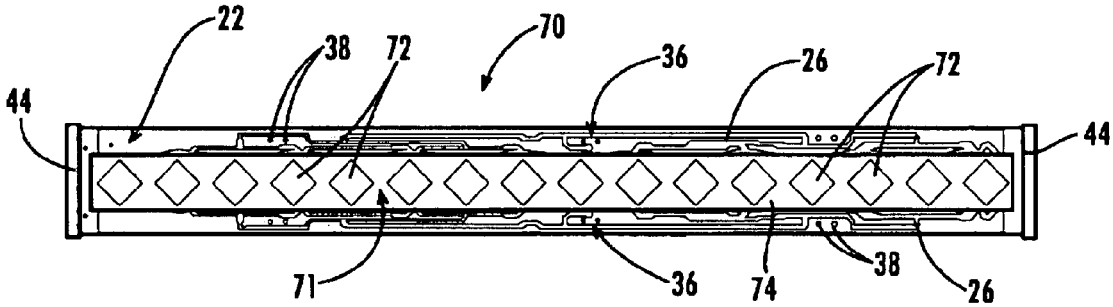
FIG. 13 is a top plan view of the partially completed antenna structure of FIG. 12.

FIGS. 12 and 13 illustrate two views of the partially assembled antenna structure 70 with the assembled stack 82 and the layers 22, 28, 74 and 76 bonded to one another and mounted on the ground layer 35, but without the radome cover 42.

FIGS. 14A, 14B, 14C, 15 and 16 illustrate various views of the assembled stack 82 in the radome antenna structure 40 forming the antenna array 70.

FIGS. 17 to 20 illustrate antenna array embodiments that are non-planar or have subsections of the antenna array that are non-planar. These designs are preferably implemented using materials for the foam core 28 that are flexible or can be thermoformed from planar sheets.

Figure 17:
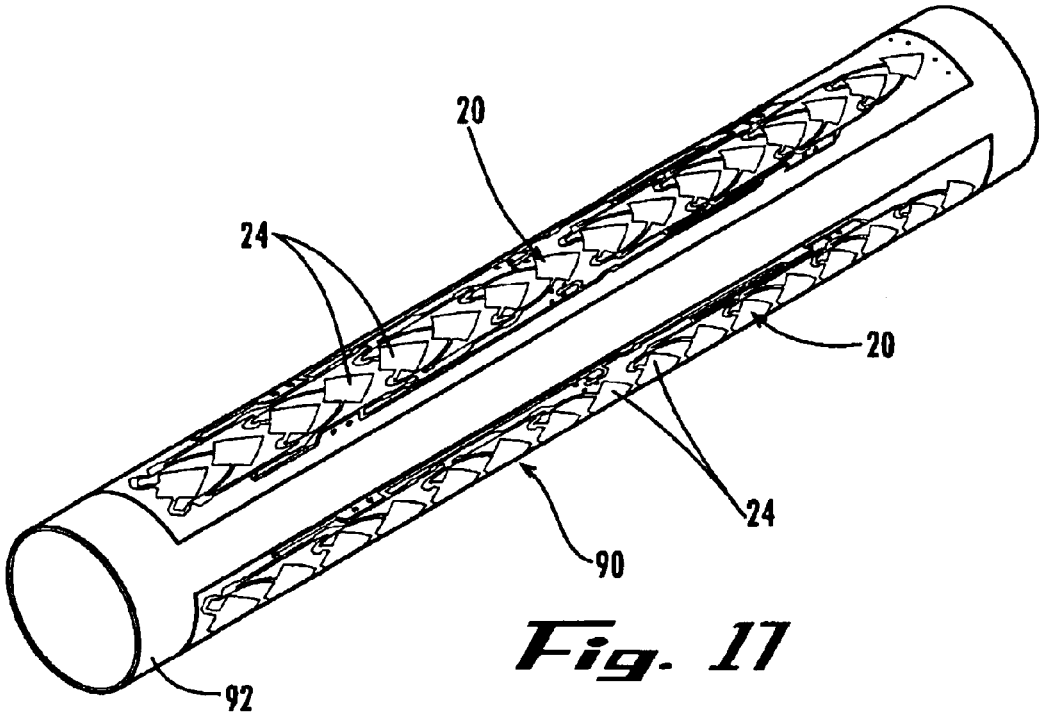
FIG. 17 is a perspective view of a curved antenna array embodiment of the present invention.

FIG. 17 illustrates a perspective view of a curved antenna array embodiment 90 of the present invention. The dielectric layers 27 and 28 can be formed of flexible materials such as compressible and conformable foam materials or can be molded or cut as before. As an example of such antenna arrays, the array 90 is formed on a cylindrical substrate or ground layer 92 and includes two of the stacks 34 forming a pair of the antennas 20 having a plurality of the radiators 24. By forming the antennas 20 on the cylindrical or curved substrate 92, the antennas 20 can provide substantially 360 degrees of coverage. A radome structure, like the structure 40 (not illustrated), can be mounted over the array 90 to form an antenna structure, which has reduced size and weight and is more aesthetically pleasing. The arrays 90 can then be mounted as desired, such as on or above the cell tower 14 (not illustrated).

Figure 18:
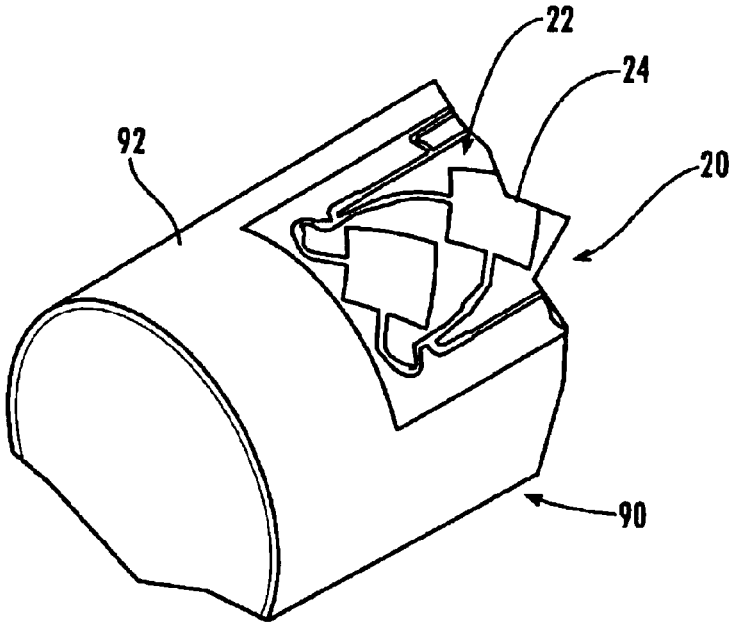
FIG. 18 is an enlarged partial perspective view of the antenna array structure of FIG. 17.

FIG. 18 is an enlarged partial perspective view of the antenna array 90 with a portion of one of the antennas 20 of FIG. 17. The array 90 also could be utilized without a radome, but could include a protective coating or other type of cover, if desired for the particular application.

The curvature of the antenna 20 around the cylinder 92 in the embodiments shown in FIGS. 17 and 18 is in the direction cross to the plane of the array 90 that lies along the length of the cylinder. The antenna array 90 is straight along the array major dimension. In this particular embodiment of an antenna array 90 having curvature, the individual antenna array radiators 24 are oriented in the same direction. This arrangement provides a condition where it can be reasonable to separate the contribution of the individual radiator from the contribution of the array when estimating the far-field pattern characteristics. In these particular embodiments in FIGS. 17 and 18 the purpose of the curvature is to shape the pattern in the plane cross to the plane of the array and to provide for compact arrangements of multiple antenna arrays around a central mounting structure. For two or more antenna arrays the signal interfaces can be separate for each array for sector coverage or the signals corresponding to each array can be further combined for wide sector or omni-directional coverage.

Figure 19A:
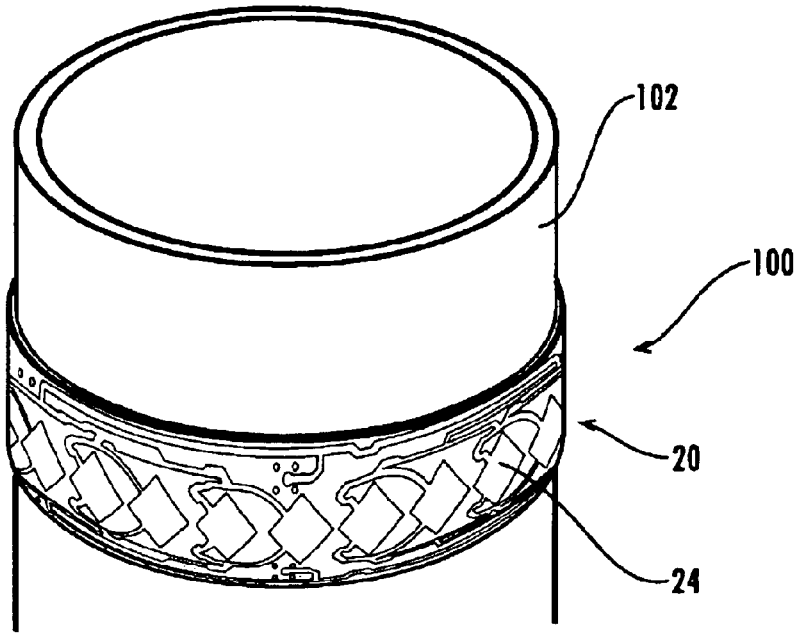
FIGS. 19A and 19B respectively are a perspective and a top view of another curved antenna array embodiment of the present invention.
Figure 19B:
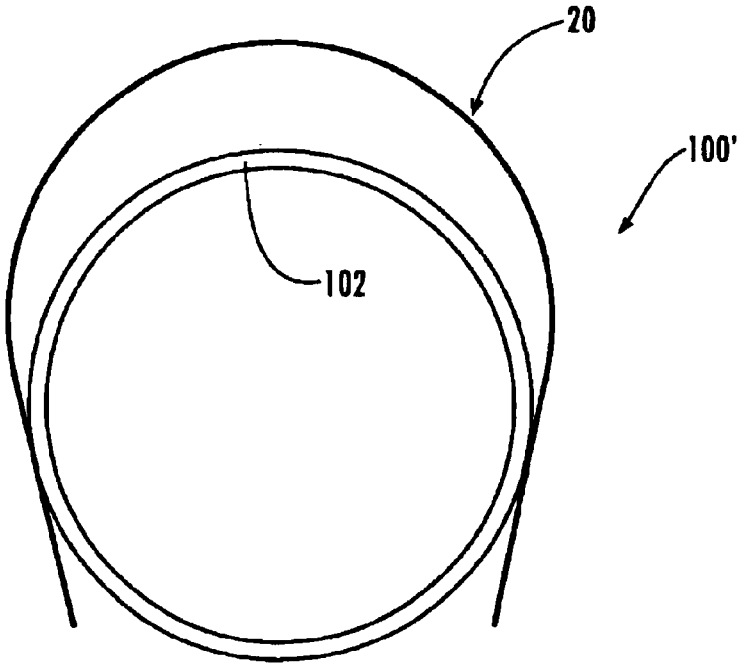

FIGS. 19A and 19B illustrates a perspective view of an antenna array 100 that is curved along the array. FIG. 19A illustrate an embodiment 100 where the array conforms to a cylindrical substrate shape 102 and FIG. 19B illustrates an embodiment 100' where the array has a non-uniform curvature relative to the uniform curvature of the cylindrical substrate 102 depicted. In this particular embodiment each individual array radiator 24 is oriented in a different direction. This general condition is useful for providing coverage to a wide sector or omni-directional coverage. Shaped patterns are possible by distributing the signals to the individual radiators 24 with non-uniform amplitude values and/or relative phase values.

Figure 20:
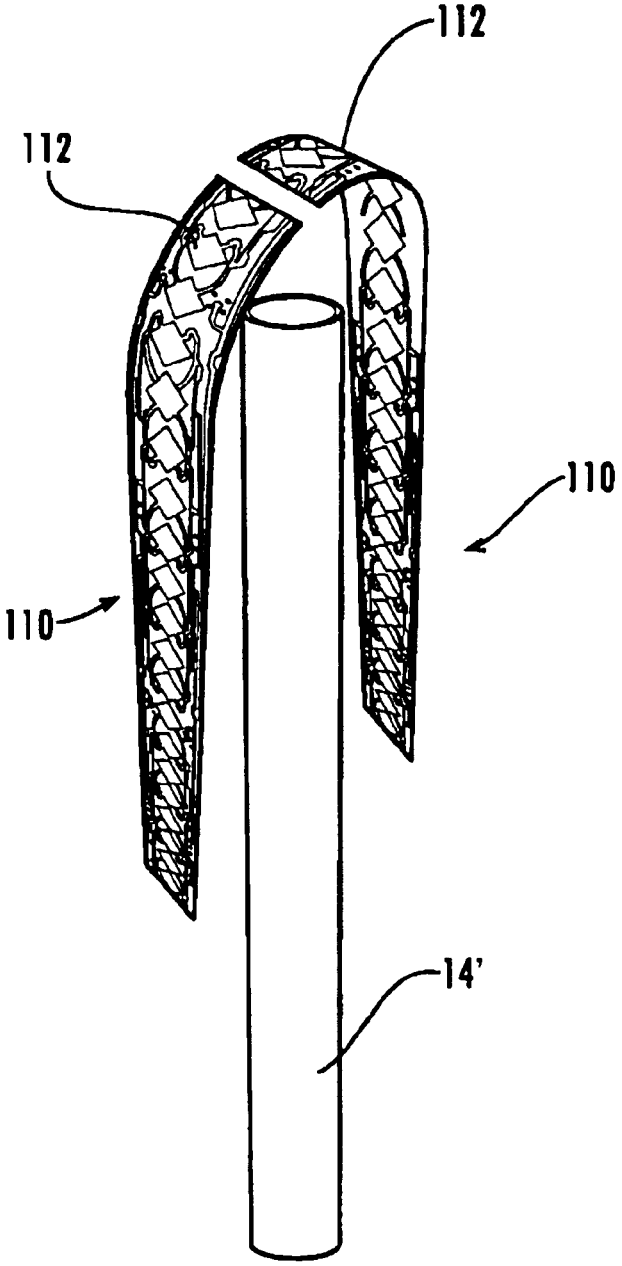
FIG. 20 is a diagrammatic illustration of utilization of curved antenna arrays of the present invention in a base-station environment.

FIG. 20 is a diagrammatic illustration of the utilization of a pair of curved antenna arrays 110 of the present invention in a base-station environment. FIG. 20 illustrates two arrays 110 that have a subsection 112 of each array that is non-planar. The embodiment 110 provides for coverage that emphasizes the regions to the sides of the mounting structure while providing for a portion of the energy to be directed above the mounting structure. This can be particularly important in providing shaped beam coverage as is often desired for communications with aircraft from the ground where the need for the greatest antenna directivity is near the horizon and there is a need to provide continuous coverage to zenith relative to the mounting structure. The arrays 110 can be mounted on the top of the cell tower 14' and include an arcuate upper end 112 to provide coverage to objects or elevations above the cell tower 14' as illustrated by the curved antennas 18 in FIG. 1.

Figure 21:
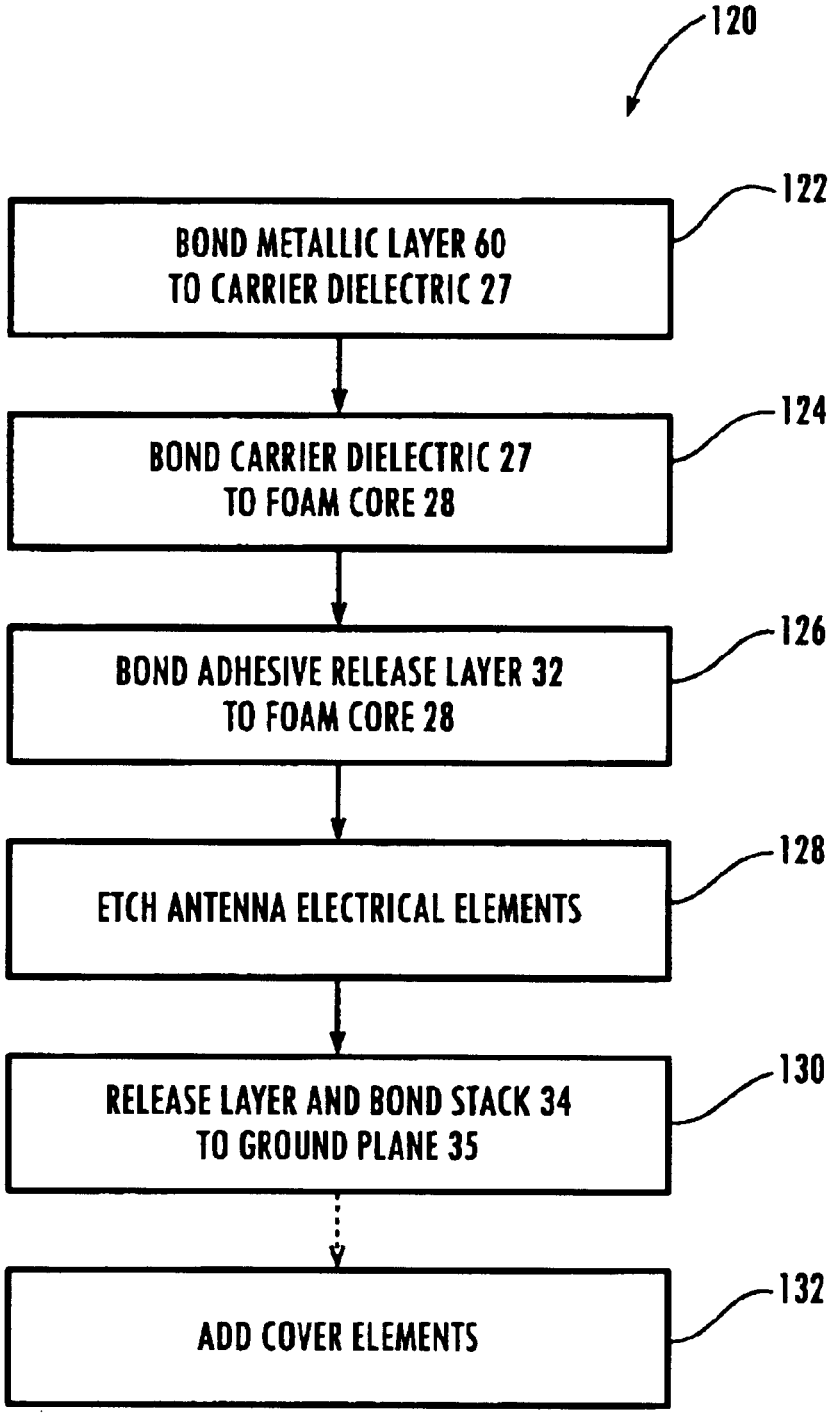
FIG. 21 illustrates the process steps for manufacturing one embodiment of the antenna arrays of the present invention.

Referring now to FIG. 21, a method 120 for manufacturing a first embodiment of the antenna arrays of the present invention is illustrated. Referring to FIG. 5, embodiments of manufacturing the antenna 20 will first be described. The metallic layer 60 is first bonded to the carrier dielectric layer 27 utilizing the adhesive layer 62 in a step 122. The carrier dielectric layer 27 then is bonded to the foam core dielectric layer 28 utilizing the adhesive layer 30 in a step 124. The dielectric layer 27 generally is a thin carrier layer for the layer 60, while the layer 28 provides the desired dielectric distance or thickness for the proper operation of the radiators 24.

The adhesive layer 32 then can be bonded to the dielectric layer 28 to form the stack or sandwich 34 in a step 126. The adhesive layer 32 preferably is a double-sided dielectric tape with a release layer (not illustrated) opposite the layer 28. The antenna electrical elements, the radiators 24 and the circuitry 26, then preferably are formed from the layer 60 by etching the desired radiator pattern in a step 128, generally including trimming the stack 34 in a conventional manner after the etching step. The stack 34 with the radiators 24 and the circuitry 26 already formed then is bonded to the ground layer 35 utilizing the adhesive layer 32 with the release layer removed in a step 130. The RF connectors 46 are mechanically attached to the conducting tray 35 and then soldered to the metallic layer 60 to make the proper electrical connections. Where desired, the remaining mechanical elements to complete the final protective cover or radome assembly 40, as illustrated in FIG. 3, then are added in an optional step 132. The electrical elements 24 and 26 also could be formed after the step 122, if desired.

Figure 22:
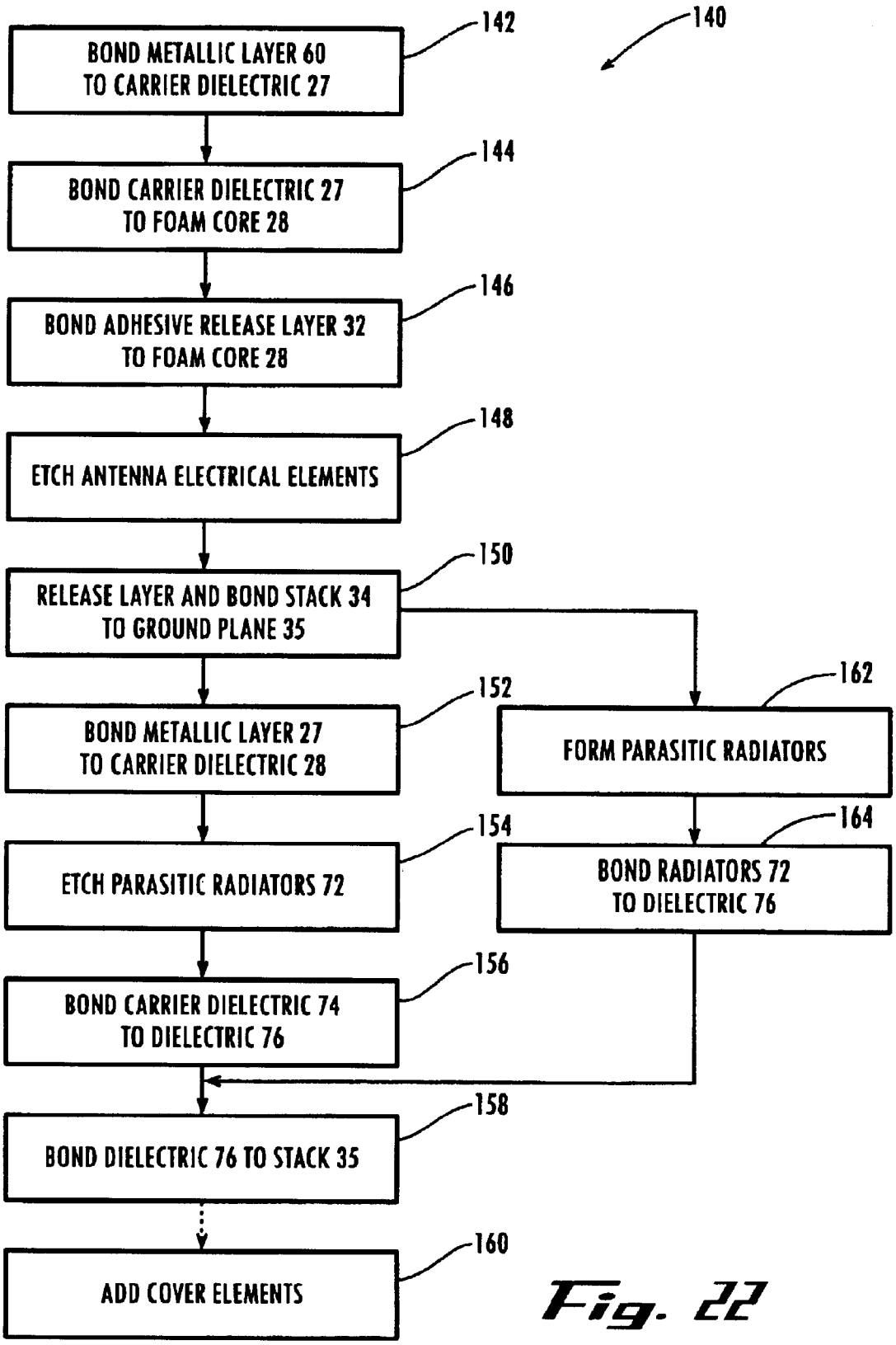
FIG. 22 illustrates the process steps for manufacturing another embodiment of the antenna arrays of the present invention.

Referring now to FIG. 22, a method 140 for manufacturing another embodiment of the antenna arrays of the present invention is illustrated. Referring to FIG. 11, embodiments of manufacturing the antenna 70 will be described. The steps 122 through the step 130 of the method 120 first can be repeated in the process 140. The metallic layer 60 is bonded to the carrier dielectric layer 27 utilizing the adhesive layer 62 in a step 142. The carrier dielectric layer 27 then is bonded to the foam core dielectric layer 28 utilizing the adhesive layer 30 in a step 144. The adhesive layer 32 then can be bonded to the foam core dielectric layer 28 to form the stack 34 in a step 146. The adhesive layer 32 again preferably is a double-sided dielectric tape with the release layer (not illustrated) opposite the foam core layer 28. The antenna electrical elements, the radiators 24 and the circuitry 26, then preferably are formed from the layer 60 by etching the desired radiator pattern in a step 148, but the antenna electrical elements 24 and 26 also could be formed after the step 142. The stack 34 with the radiators 24 and the circuitry 26 already formed then is bonded to the conducting tray 35 utilizing the adhesive layer 32 in a step 150.

As a first optional embodiment, the metallic layer for forming the parasitic elements 72 can be bonded to the thin carrier dielectric layer 74 utilizing the adhesive layer 73 in a step 152, forming the stack 71. The parasitic elements can be etched from the metallic layer to form the individual radiator patches 72 in a step 154. The stack 71 with the carrier dielectric layer 74 is then bonded to the dielectric layer 76 utilizing the adhesive layer 78 in a step 156. The dielectric layer 76 is then bonded to the stack 34 by bonding the layer 76 to the top of the corresponding radiators 24 on the stack 22 utilizing the adhesive layer 80 in a step 158. The RF connectors 46 again are mechanically attached to the conducting tray 35 and then soldered to the metallic layer 60 to make the proper electrical connections. As before, where desired, the remaining mechanical elements to complete the final protective cover or radome assembly 40, as illustrated in FIG. 9, then are added in an optional step 160.

In another optional embodiment, the radiators 72 also can be bonded directly onto the dielectric layer 76, eliminating the carrier dielectric layer 74 and the etching step 154. In this embodiment, following the step 150, the radiators 72 are laser or die-cut to form the individual radiators in a step 162. The elements 72 then are individually bonded to the dielectric layer 76 in a step 164. The remaining steps then are the same as the steps 158 and optionally 160, as previously described.

Figure 23:
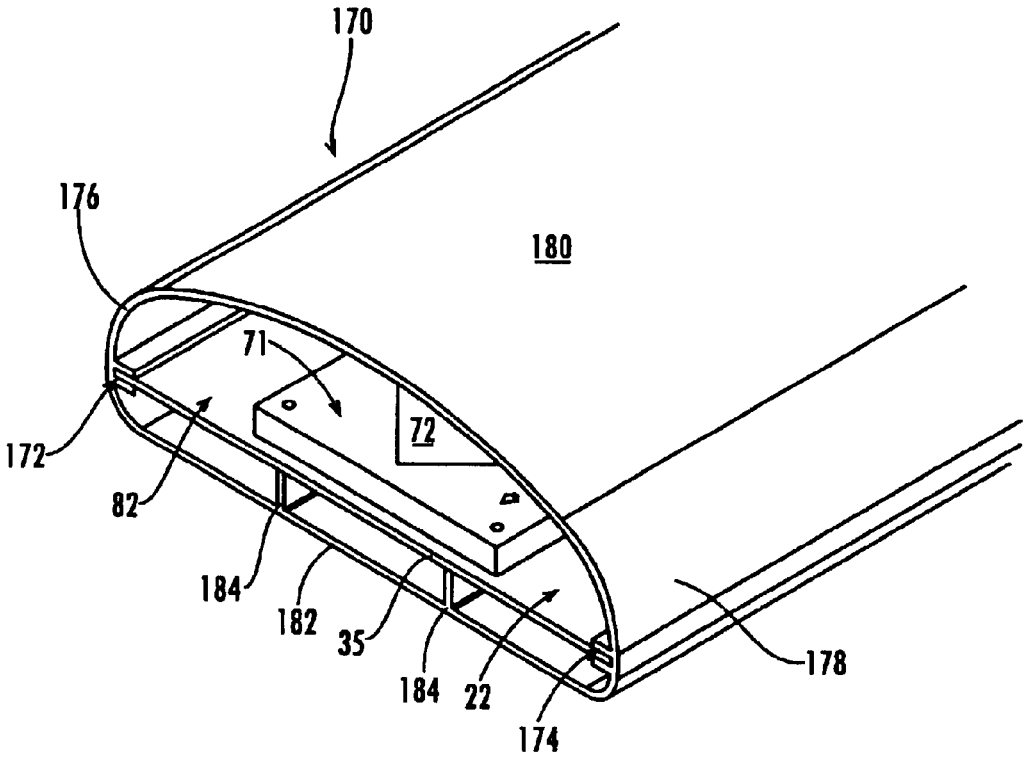
FIG. 23 is a partial perspective illustration of an antenna array radome embodiment of the present invention that can support a completed antenna structure.
Figure 24:
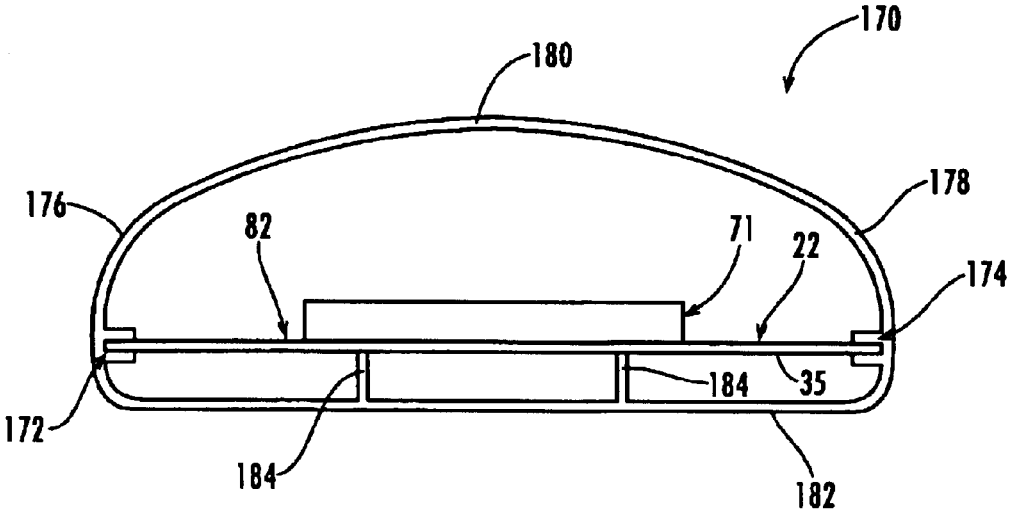
FIG. 24 is a side or end view of the radome of FIG. 23 with a completed antenna structure mounted therein.
Figure 25:
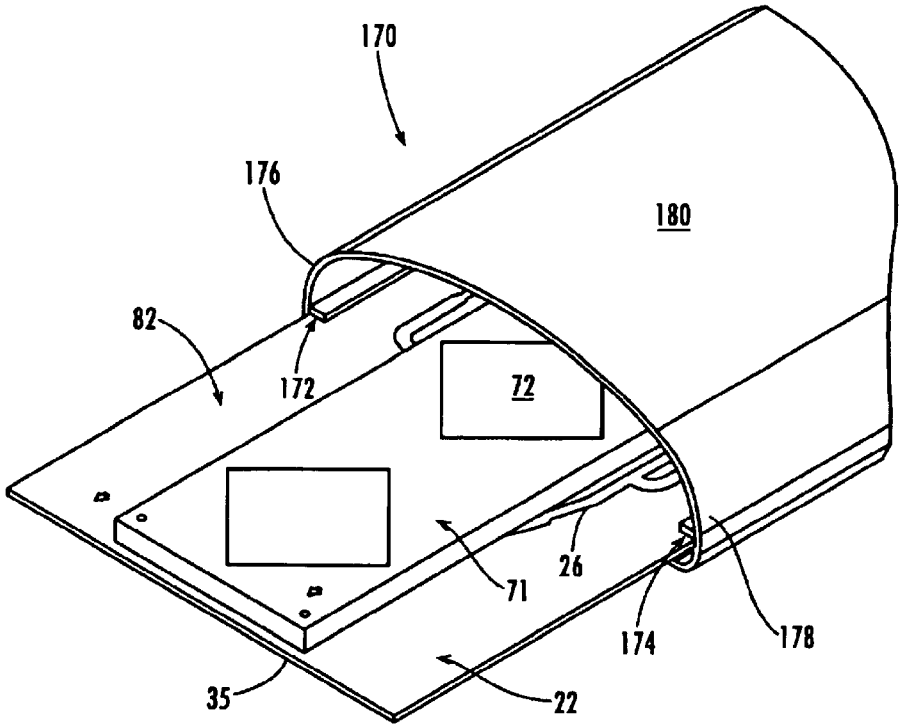
FIG. 25 is a partial perspective illustration of the radome of FIG. 23 illustrating the mounting of the antenna structure therein.

As discussed, the ground layer also could merely be another metallic foil like the metallic layer 60, which would eliminate the rigid metal support conducting tray 35. In that embodiment, the stack 34 or 82 with the ground layer foil would be supported by a non-conducting support, such as a radome 170, as illustrated in FIGS. 23–25. The radome 170 can be formed of multiple parts, welded or mechanically assembled together, or can be an integral extruded unit or otherwise formed in a unitary piece, as illustrated. The radome 170 can be formed from the same or similar materials as the radome cover 42. Although the support for the stacks 34 or 82 can be formed in any number of configurations, the radome 170 includes a pair of opposed slots 172 and 174 formed in opposite side walls 176 and 178 of the radome 170. The side walls 176 and 178 abut or are formed with a top cover 180, illustrated as having an arcuate shape, but which could be planar or of other shapes as desired. The side walls 176 and 178 also abut or are formed with a bottom member 182. Again, the bottom 182 is illustrated as having a planar shape, but could have other shapes as desired. The stack 82 is illustrated mounted in the radome 170 in the slots 172 and 174. Preferably, the stack 34 or 82 with the metal foil back plane 35 is slid into the radome 170 (illustrated in FIG. 25) and then the open ends are closed with end caps, similar to the caps 44 (not illustrated). Where desirable, the bottom 182 can include one or more supports 184, mounted thereto or formed therewith, (a pair of which are illustrated) to help support the stack 34 or 82.

As described, the low-cost antenna array designs of the present invention use low-cost individual components suitable for printed circuit board manufacturing techniques that can be assembled in a short period of time with little or no required adjustment to achieve the desired performance after assembly.

While the invention has been described in several preferred embodiments, those skilled in the art will readily appreciate that many modifications, additions and deletions can be made to the invention as described and disclosed without departing from the spirit and scope of the present invention. For example, although only one parasitic structure 76 having the elements 72 thereon has been illustrated with the antenna 70, one or more additional parasitic structures can be mounted on top of the antenna 70, if desired. The foam core layer 28 and the foam layer 76 have been illustrated as unitary structures, but could also be multi-layer or laminate structures formed by welding, such as with heat or ultrasonic techniques, two or more foam core layers together. Also, the foam core layer 28 and the foam layer 76, when utilized with curved ground layers, can conform or be "curved" by being constructed of piece-wise linear or planar sections, rather than being continuous curved sections. The foam core layer 28 and the foam layer 76, thus can be piece-wise linear or planar approximations for the substantially continuously curved ground layer surface portion or portions.

What is claimed is:

1. An antenna array having a plurality of layers, comprising:

a metallic layer having at least one antenna electrical radiator element and feed element formed therein;

a first thin carrier dielectric layer having a top surface and a bottom surface, said metallic layer formed over said first thin carrier dielectric layer;

a foam core layer having a top surface and a bottom surface, wherein said first thin carrier dielectric layer is formed over said top surface of said foam core layer, said bottom surface of said thin carrier dielectric layer and said top surface having equal surface areas; and a bonding layer formed on said bottom surface of said foam core layer, wherein said bonding layer is bonded to a metallic ground layer.

2. The antenna defined in claim 1, wherein said metallic layer is adhesively bonded to said first thin carrier dielectric layer.

3. The antenna defined in claim 1, wherein said first thin carrier dielectric layer is adhesively bonded to said foam core layer.

4. The antenna defined in claim 1, wherein said metallic ground layer is a thin metallic layer.

5. The antenna defined in claim 4, further including a non-conductive radome cover structure enclosing said antenna layers and providing support for said layers.

6. The antenna defined in claim 1, further including said antenna layers adhesively bonded to one another.

7. The antenna defined in claim 1, further including a radome cover structure enclosing said antenna layers.

8. The antenna defined in claim 1, wherein at least a portion of said plurality of antenna layers are formed on a curved ground layer.

9. The antenna defined in claim 8, wherein each of said plurality of antenna layers are formed from a flexible material to conform to said curved ground layer.

10. The antenna defined in claim 8, wherein said foam core layer is formed into a curved shape to fit said curved ground layer.

11. The antenna defined in claim 1, wherein said metallic ground layer is also a conducting tray to structurally support said antenna array.

12. The antenna defined in claim 1, wherein said metallic ground layer is flexible.

13. An antenna array having a plurality of layers, comprising:

a metallic layer having at least one antenna electrical radiator element and feed element formed therein;

a first thin carrier dielectric layer, said metallic layer formed over said first thin carrier dielectric layer;

a foam core layer having a top surface and a bottom surface, wherein said first thin carrier dielectric layer is formed over said top surface of said foam core layer;

a bonding layer formed on said bottom surface of said foam core layer, wherein said bonding layer is bonded to a metallic ground layer; and at least a second dielectric layer formed over said metallic layer and having at least one parasitic radiator element formed over a top surface of said second dielectric layer, wherein said at least one parasitic radiator element is electrically coupled with a corresponding radiator element in said metallic layer.

14. The antenna defined in claim 13, further including said plurality of parasitic radiator elements formed over a top surface of a second thin carrier dielectric layer and said second thin carrier dielectric layer formed over said second dielectric layer.

15. The antenna defined in claim 13, further including said layers adhesively bonded to one another.

16. The antenna defined in claim 13, further including a radome cover structure enclosing said antenna layers.

17. The antenna defined in claim 13, wherein said metallic ground layer is a thin metallic ground layer.

18. The antenna defined in claim 17, further including a non-conductive radome cover structure enclosing said antenna layers and providing support for said antenna layers.

19. The antenna defined in claim 13, wherein at least a portion of said plurality of antenna layers are formed over a curved ground layer.

20. The antenna defined in claim 19, wherein each of said plurality of antenna layers are formed from a flexible material to conform to said curved ground layer.

21. The antenna defined in claim 19, wherein said foam core layer is formed into a curved shape to fit said curved ground layer.

22. The antenna defined in claim 13, wherein said metallic ground layer is a substantially rigid support metal layer.

23. An antenna array having a plurality of layers, comprising:

a metallic layer having at least one antenna electrical radiator element and feed element formed therein;

a first thin carrier dielectric layer, said metallic layer formed over said first thin carrier dielectric layer;

a foam core layer having a top surface and a bottom surface, wherein said first thin carrier dielectric layer is formed over said top surface of the foam core layer;

at least a second dielectric layer formed over said metallic layer; and at least one parasitic radiator element formed on a top surface of a second thin carrier dielectric layer, wherein said at least one parasitic radiator element is electrically coupled with at least one corresponding radiator element in said metallic layer, said second thin carrier dielectric layer formed over said second dielectric layer wherein said layers are bonded to one another forming a stack, wherein a bonding layer is formed on a bottom surface of said foam core layer of said stack, and wherein said stack is bonded to a metallic ground layer by said bonding layer.

24. The antenna defined in claim 23, further including a radome cover structure enclosing said antenna layers.

25. The antenna defined in claim 23, wherein said metallic ground layer is a thin metallic layer.

26. The antenna defined in claim 25, further including a non-conductive radome cover structure enclosing said antenna layers and providing support for said antenna layers.

27. The antenna defined in claim 23, wherein at least a portion of said plurality of antenna layers are formed on a curved ground layer.

28. The antenna defined in claim 27, wherein each of said plurality of antenna layers are formed from a flexible material to conform to said curved ground layer.

29. The antenna defined in claim 27, wherein said foam core layer is formed into a curved shape to fit said curved ground layer.

30. The antenna defined in claim 23, wherein said metallic ground layer is a substantially rigid support metal layer.

31. A method of manufacturing an antenna array, comprising the steps of:

forming a foam core layer having a top and a bottom surface;

bonding a metallic layer over a first thin carrier dielectric layer having a top surface and a bottom surface and bonding said first thin carrier dielectric layer to said top surface of said foam core layer wherein said top surface of said foam core layer and said bottom surface of said first thin carrier dielectric layer have an equal surface area;

applying a bonding layer on said bottom surface of said foam core layer;

etching at least one radiator element and feed element in said metallic layer; and forming a metallic ground layer and bonding said bonding layer with said foam core layer, said first thin carrier dielectric layer and said metallic layer to said metallic ground layer.

32. The method defined in claim 31, further including the step of enclosing said antenna layers in a radome cover.

33. The method defined in claim 31, further including the step of forming said metallic ground layer from a thin metallic layer.

34. The method defined in claim 33, further including the steps of forming a non-conductive radome cover structure for providing support for said antenna layers and enclosing and supporting said antenna layers in said radome cover structure.

35. The method defined in claim 31, including the step of forming at least a portion of said plurality of antenna layers on a curved ground layer.

36. The method defined in claim 35, including the step of forming each of said plurality of antenna layers from a flexible material and conforming said antenna layers to said curved ground layer.

37. The method defined in claim 35, including the step of forming said foam core layer into a curved shape fitting said curved ground layer.

38. The method defined in claim 31, including the step of forming said metallic ground layer as a substantially rigid support metal layer for said antenna layers.

39. A method of manufacturing an antenna array, comprising the steps of:

forming a foam core layer having a top and a bottom surface;

bonding a metallic layer over a first thin carrier dielectric layer and bonding said first thin carrier dielectric layer to said to surface of said foam core layer;

applying a bonding layer on said bottom surface of said foam core layer;

etching at least one radiator element and feed element in said metallic layer;

forming a metallic ground layer and bonding said bonding layer with said foam core layer, said first thin carrier dielectric layer and said metallic layer to said metallic ground layer;

bonding at least a second dielectric layer onto said metallic layer; and forming at least one parasitic radiator element on a top surface of said second dielectric layer which couple with corresponding at least one radiator element formed in said metallic layer.

40. The method defined in claim 39, further including the steps of forming said at least one parasitic radiator element on a top surface of a second thin carrier dielectric layer and bonding said second thin carrier dielectric layer to said second dielectric layer.

41. The method defined in claim 39, further including the step of enclosing said antenna layers in a radome cover structure.

42. The method defined in claim 39, including the step of forming at least a portion of said plurality of antenna layers on a curved ground layer.

43. The method defined in claim 42, including the steps of forming each of said plurality of antenna layers from a flexible material and conforming said antenna layers to said curved ground layer.

44. The method defined in claim 42, including the step of forming said foam core layer into a curved shape fitting said curved ground layer.

45. The method defined in claim 39, including the step forming said metallic ground layer as a substantially rigid support metal layer for said antenna layers.

46. A method of manufacturing an antenna array, comprising the steps of:

forming a foam core layer having a top and a bottom surface;

bonding a metallic layer over a first thin carrier dielectric layer and bonding said first thin carrier dielectric layer to said top surface of said foam core layer;

applying a bonding layer on said bottom surface of said foam core layer;

etching at least one radiator element and feed element in said metallic layer;

forming a metallic ground layer and bonding said bonding layer with said foam core layer, said first thin carrier dielectric and said metallic layer to said metallic ground layer;

bonding at least a second dielectric layer onto said metallic layer radiator and feed elements; and forming at least one parasitic radiator element on a top surface of said second dielectric layer.

47. The method defined in claim 46, further including the step of enclosing said antenna layers in a radome cover.

48. The method defined in claim 46, further including the step of forming said metallic ground layer from a thin metallic layer.

49. The method defined in claim 46, further including the step of forming a non-conductive radome cover structure for supporting and enclosing said antenna layers in said radome cover structure.

50. The method defined in claim 46, including the step of forming at least a portion of said plurality of antenna layers on a curved ground layer.

51. The method defined in claim 50, including the steps of forming each of said plurality of antenna layers from a flexible material and conforming said antenna layers to said curved ground layer.

52. The method defined in claim 50, including the step of forming said foam core layer into a curved shape fitting said curved ground layer.

53. The method defined in claim 46, including the step of forming said metallic ground layer as a substantially rigid support metal layer for said antenna layers.

* * * * *